US007249559B2

(12) United States Patent
McNeil

(10) Patent No.: US 7,249,559 B2
(45) **Date of Patent: *Jul. 31, 2007**

(54) METHOD FOR CLEANING A POROUS PRINTING SURFACE BY EXTRUDING LIQUID THROUGH SURFACE

(75) Inventor: Kevin Benson McNeil, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/945,282

(22) Filed: Sep. 20, 2004

(65) Prior Publication Data

US 2005/0034621 A1 Feb. 17, 2005

Related U.S. Application Data

(63) Continuation of application No. 10/680,515, filed on Oct. 7, 2003, now abandoned, which is a continuation of application No. 10/050,276, filed on Jan. 16, 2002, now Pat. No. 6,647,883.

(51) Int. Cl.
*B41F 35/00* (2006.01)
*B41M 99/00* (2006.01)

(52) U.S. Cl. ..... 101/483; 101/425; 101/129; 101/487

(58) Field of Classification Search ..... 101/114, 101/116, 119, 120, 123, 124, 125, 129, 216, 101/219, 153, 170, 487, 491, 423, 424, 425; 118/264, 266; 427/208.8, 207.1, 208.2, 208.4, 427/428, 256, 258, 261, 288; 156/289, 578
See application file for complete search history.

(56) References Cited

U.S. PATENT DOCUMENTS

| | | | | |
|---|---|---|---|---|
| 1,668,322 | A * | 5/1928 | Kessler, Jr. | 101/152 |
| 2,185,342 | A | 1/1940 | Keller | |
| 3,255,695 | A | 6/1966 | Johnson et al. | |
| 3,803,684 | A | 4/1974 | Broderick | |
| 3,986,450 | A | 10/1976 | Zimmer | |
| 4,526,098 | A | 7/1985 | Bachman | |
| 4,631,798 | A | 12/1986 | Ogino et al. | |

(Continued)

FOREIGN PATENT DOCUMENTS

EP 0 392 826 A2 10/1990

(Continued)

*Primary Examiner*—Leslie J. Evanisko
(74) *Attorney, Agent, or Firm*—David K. Mattheis; Leonard W. Lewis; Steven W. Miller

(57) ABSTRACT

Method and apparatus in which a first liquid is extruded through a porous plate to a first surface, a second liquid is externally applied over the first liquid on the first surface. The second liquid is subsequently removed from the first surface. In some embodiments, the first liquid is a release agent, the second liquid is a printing agent, and a sheet material is contacted with the printing agent on the printing surface, whereby the release agent prevents the adhesion of the printing agent and the sheet material to the printing surface and thereby allows the sheet material to be easily separated from the printing surface. In some embodiments, the printing agent is an adhesive and the release agent prevents the adhesive from strongly adhering to or accumulating on the printing surface.

4 Claims, 9 Drawing Sheets

U.S. PATENT DOCUMENTS 4,693,179 A * 9/1987 Watts ..... 101/119
4,770,909 A 9/1988 McIntyre
4,871,593 A 10/1989 McIntyre
5,096,584 A 3/1992 Reddy et al.
5,099,758 A * 3/1992 Hassler et al. ..... 101/120
5,132,706 A 7/1992 Yuasa et al.
5,264,899 A 11/1993 Mandel
5,403,649 A 4/1995 Morgan et al.
5,754,930 A 5/1998 Stark et al.
5,759,626 A 6/1998 Hefele
5,779,795 A 7/1998 Bucher et al.
5,860,361 A * 1/1999 Nanjyo et al. ..... 101/424
6,212,355 B1 4/2001 Bunn et al.
6,502,506 B2 1/2003 Endo et al.

FOREIGN PATENT DOCUMENTS

EP 0 631 837 A1 1/1995
GB 1 541 804 3/1979
JP 56-046755 * 4/1981

* cited by examiner

METHOD FOR CLEANING A POROUS PRINTING SURFACE BY EXTRUDING LIQUID THROUGH SURFACE

CROSS REFERENCE TO RELATED APPLICATIONS

This application is a continuation application of U.S. patent application Ser. No. 10/680,515 filed Oct. 7, 2003 now abandoned; which is a continuation application of U.S. patent application Ser. No. 10/050,276 filed Jan. 16, 2002, issued as U.S. Pat. No. 6,647,883 B1.

FIELD OF THE INVENTION

This invention relates to processes and apparatus for the contact printing of liquids onto sheet materials.

BACKGROUND OF THE INVENTION

In contact printing, a printing agent is applied onto a printing surface, a sheet material is impressed against the printing surface, and the sheet material is then separated from the printing surface. The processes and apparatus for such contact printing can take many forms. For example, the printing surface may be formed on a flat plate or block, on a cylindrical shell or roller, on a removable plate mounted on a shell or roller, or in any other required or convenient form. The sheet material may be processed as a continuous web, as individual sheets, as a web already partially separated into individual sheets, such as by perforation, as folded individual sheets or webs, and so on. The printing agent may be an ink, a dye, an adhesive, or any other material having the fluid properties necessary for the particular printing application. The printing agent may be applied onto the printing surface by means of an applicator, such as a roller, or may be extruded through a porous printing plate onto the printing surface.

In a contact printing process, the printing agent may accumulate on the printing surface and form a hard protuberance or a mass that may detach from the printing surface and contaminate the process. Also, the printing agent may adhere to both the printing surface and the sheet material with sufficient strength to cause the rupture or distortion of the sheet material when it is separated from the printing surface. For example, the avoidance of ruptures or distortion is especially important when printing a relatively aggressive adhesive onto a relatively thin and conformable film, such as in the manufacture of a film for wrapping food or food containers, but may be especially difficult to achieve.

It is preferable to prevent or minimize the strong adhesion of the printing agent to the printing surface, rather than to add process steps or equipment in an attempt to compensate for its occurrence. For example, a release agent such as an oil may be externally applied to a printing roller by means of an applicator roller, a brush, or a non-contact applicator. Such an approach is limited in its usefulness by practical considerations such as the requirement for space immediately adjacent the printing roller 16 and the difficulty inherent in attempting to apply the release agent in equal amounts per unit area on specific portions of the printing surface corresponding to where the printing agent will be applied, in order to minimize the usage of the release agent and the possibility of contamination of the process by excess release agent.

Also, the consistent external application of a release agent in pure form at a relatively low rate is often difficult to achieve. An emulsion of a release agent may be used to facilitate the external application, but the emulsifier often has undesirable properties relative to the process and the finished product. Therefore, it may be necessary to volatilize a part of the emulsion immediately after its application to the printing surface, for example, through the application of heat energy. However, the temperature required for volatilization may be excessive for the material of which the printing surface is made, which is often selected on the basis of its ease of machining.

In addition, printing processes in which the printing agent is extruded through a porous printing plate present additional difficulties with respect to the prevention of the adhesion of the printing agent to the printing surface. These difficulties arise from the direct application of the printing agent to the printing surface and the resultant effective preclusion of the use of an externally applied release agent, because of the impracticality of applying the release agent onto the printing surface beneath the printing agent.

An alternative approach to the prevention of the adhesion of the printing agent to the printing surface is to use a printing plate impregnated with a fixed quantity of a release agent that is depleted over a number of cycles of the process. In this approach, the progressive depletion of the release agent may lead to a progressive reduction in effectiveness. A similar approach is to make the printing surface of a material such as silicone rubber or a urethane having good release properties. However, a printing plate fabricated of such a material often lacks the desired durability. Another approach is to apply a more durable release agent, which may be renewed when worn or degraded, to the printing surface. Examples of such durable release agents are various plasma coatings, polymer coatings, and films or sheets of such materials, which may be affixed to the printing surface. However, the use of such durable materials requires the continuing monitoring, maintenance, and replacement of the materials in order to maintain their effectiveness. Also, damage to such materials or their structural failure may result in the contamination of the process.

Another alternative approach to the prevention of the adhesion of the printing agent to the printing surface is to apply a low surface energy coating to the printing surface. For example, silicone-based and fluoropolymer-based coatings may have the desired release properties. However, some such low surface energy coatings lack sufficient durability for practical use in contact printing processes. Also, the curing temperatures required for the proper application of some of these coatings exceeds the temperatures at which creep or the failure may occur in the materials of which the printing plates are made. For example, it may not be practical to apply a fluoropolymer having a curing temperature of approximately 400 degrees C. to a structural material having a creep temperature of approximately 110 degrees C. and a failure temperature of approximately 200 degrees C.

Yet another approach is to maintain a process condition in which the printing agent will not strongly adhere to the printing surface. For example, some adhesives can be prevented from strongly adhering to a surface by maintaining that surface at a sufficiently high temperature. However, the required high temperature may be excessive for the sheet material being impressed in a contact printing process. In addition, at the required temperature, the adhesive may flow onto other surfaces where its presence is problematic. As another example, an adhesive may be prevented from adhering to a surface by chilling that surface to a temperature at which atmospheric moisture condenses and forms a layer of water on the surface. However, the presence of water in its liquid state is often problematic. Also, the rates of condensation and of the accumulation of water on the surface depends on the relative humidity, the rate at which the sheet material removes the water from the surface, and other factors. Variations in these factors can lead to the accumulation of ice on the surface, which often is unacceptable. In addition, the chilling of a surface to a condensation temperature typically requires a channel near the surface for the circulation of a chilling agent, which limits the configuration of the printing plate.

Therefore, a need exists for a contact printing process and apparatus in which the adhesion to a printing surface of a printing agent and a sheet material onto which it is printed can be prevented, without an external application of a release agent, a progressive depletion of a fixed quantity of a release agent, a non-durable printing surface, a source of process contamination in the form of a durable release agent, or an extreme process condition.

SUMMARY OF THE INVENTION

The present invention provides methods and apparatus in which a first liquid is extruded through a porous printing plate to its printing surface, a second liquid is externally applied over the first liquid on the printing surface, and a sheet material is contacted with the printing surface in order to print the second liquid onto the sheet material. In some embodiments, the first liquid is a release agent, the second liquid is a printing agent that is applied over the release agent on the printing surface, and a sheet material is contacted with the printing agent on the printing surface to print the printing agent onto the sheet material, whereby the release agent prevents the adhesion of the printing agent and the sheet material to the printing surface and thereby allows the sheet material to be easily separated from the printing surface. In some embodiments, the printing agent is an adhesive and the release agent prevents the adhesive from strongly adhering to or accumulating on the printing surface.

DETAILED DESCRIPTION OF THE INVENTION

For the purposes of this description, the term "printing plate" is used to denote a component or an assembly having a prepared surface designated as its "printing surface" and with which printing is done by impressing a sheet material against the printing surface. Included in this meaning are the various forms that such a component or assembly can take, such as a flat plate or block, a cylindrical shell or roller, a removable plate mounted on a shell or roller, or any other required or convenient form. Corresponding terms such as "printing cylinder", "printing roller", and "printing shell" may be used to denote the specific form of a printing plate being described with respect to a particular embodiment. When one such specific form or embodiment is described, it is intended that the disclosed characteristics of that form or embodiment relevant to the present invention be understood to be applicable to the other forms and embodiments, as well.

All documents cited herein are, in relevant part, incorporated herein by reference; the citation of any document is not to be construed as an admission that it is prior art with respect to the present invention.

In this description, printing onto a sheet material is described in terms of the sheet material being impressed against, or brought into contact with, a printing surface. These terms are intended to convey the concepts of contact printing and, therefore, include the presence of a printing agent between the actual printing surface and the sheet material, i.e., the direct contact of the sheet material and the printing surface in the absence of any intermediary printing agent is not required for the two to be considered to be in an impressing or contacting state.

Figure 1:
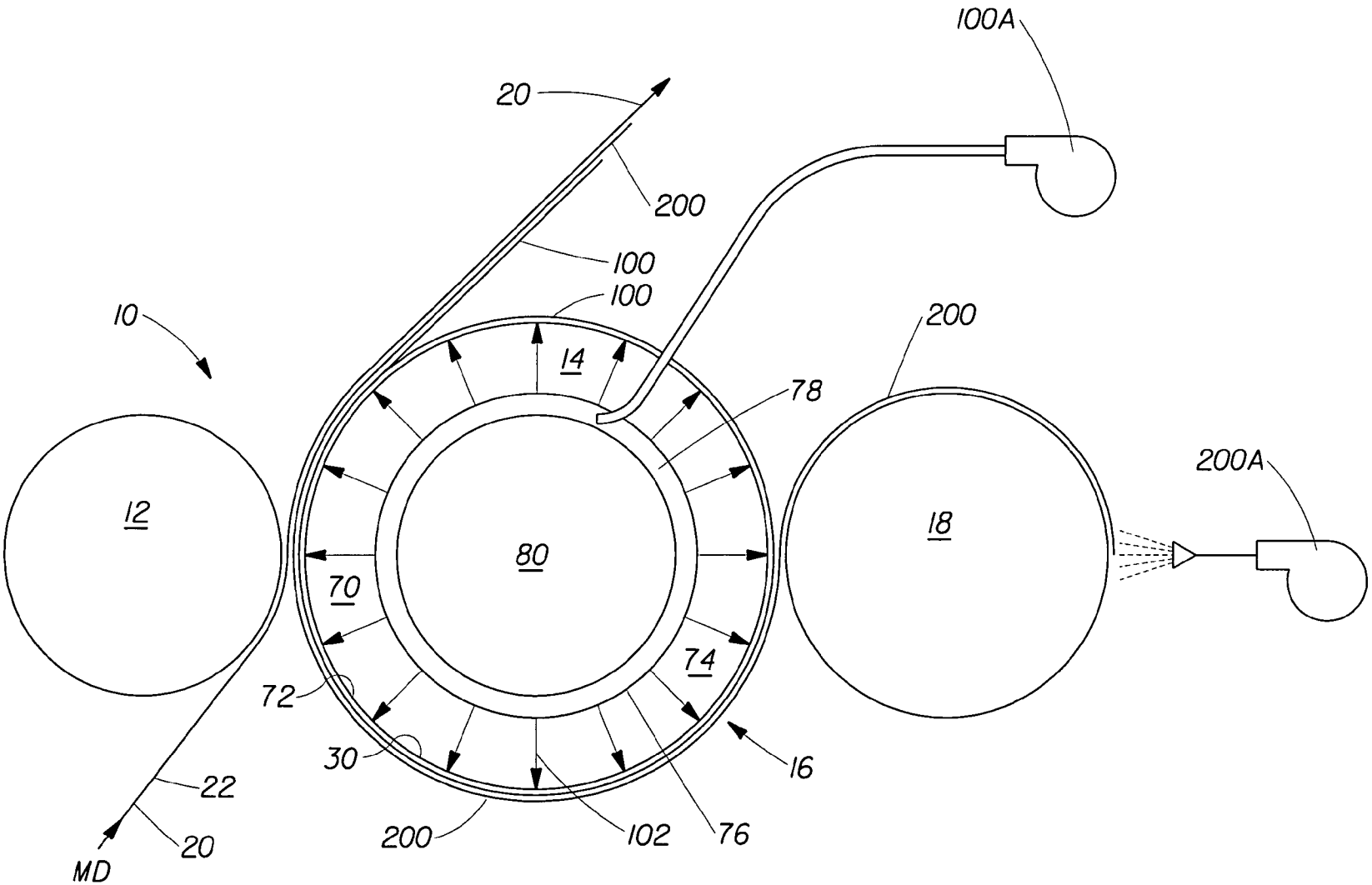
FIG. 1 shows an overview of the process flow and apparatus of the present invention.

The present invention may be used to print onto a sheet material 20 in an apparatus 10, shown schematically in FIG. 1. The apparatus 10 may be integrated into a manufacturing line such that the printed sheet material 20 may be manufactured "on-line". As used herein, the term "integrated" refers to interconnected process modules that operate concurrently to produce finished products from source materials. The term "on-line" is used to refer to the process of manufacturing an element of a finished product on an apparatus that is integrated with the manufacturing line.

In this embodiment, the sheet material 20 is a web 22, which may comprise a single material or a laminate of suitable materials. For example, in an embodiment in which the process of the present invention is used to make a film for wrapping food or food containers, the web 22 may comprise a high density polyethylene film. A food wrap film may have a thickness of at least about 0.005 mm. Also, a food wrap film may have a thickness of no more than about 0.05 mm. In some embodiments, the web 22 may comprise, for example, a monolithic film, a formed film, a foam, a non-woven material, a paper material, or any other sheet material. In some embodiments, the sheet material 20 may have the form of an individual sheet, such as a sheet of paper, a laminated wood product, or a surface of another manufactured product, for example.

The web 22 is fed into the apparatus 10 by a web delivery system (not shown in the Figures). The web delivery system preferably feeds the web 22 into the apparatus 10 at a determinate feed rate, while maintaining a determinate level of tension. Each web delivery system preferably comprises an unwinder system, a tensioning and metering system, and a tracking device. The tensioning and metering system preferably comprises a tensioning device, such as a dancer, a metering device, such as a powered roll or S-wrap roll pair, and a feedback system to control the speed of the unwinder system. Suitable web delivery systems are available from the Curt G. Joa Corporation of Sheboygan Falls, Wis., U.S.A. The tracking device preferably guides the web 22 to place the centerline of the web exiting the tracking device at a predetermined lateral position. A tracking device manufactured by the Fife Corporation of Oklahoma City, Okla., U.S.A., under the trade designation Fife A9 is an example of a suitable tracking device.

Examining the process of FIG. 1 in greater detail, the web 22 is provided to the apparatus 10 in a machine direction. As used herein, the term "machine direction" refers to the general direction of movement of the materials being processed. The machine direction is shown by the arrows MD, which point downstream along the machine direction. The term "downstream" refers herein to a position or a direction toward the latter steps of the process, relative to another position, while the term "upstream" refers herein to a position or a direction toward the earlier steps of the process, relative to another position, i.e., to the opposite of downstream. The term "cross machine direction" refers to both of the pair of opposing vectors defining an axis generally in the plane of the web material being processed and perpendicular to the machine direction. The term "orthogonal direction" refers to a direction generally orthogonal to both the machine direction and the cross machine direction. In general, in a typical web contact printing process, the web is fed in the machine direction, is guided in the cross machine direction, and is impressed against the printing plate in the orthogonal direction.

The printing plate 14 in the embodiment of FIG. 1 has the form of a printing roller 16, comprising a process roller 70 having a cylindrical shell 74. The term "process roller" or, alternatively, "process roll", is used herein to denote a machine element that is known in the art as commonly having a shaft aligned with its longitudinal axis, a structure generally mounting a solid body or a shell on the shaft, an associated supporting structure having a shaft bearing, and an associated drive system, if the roller is driven. An inner cavity 78 is formed by the cylindrical shell 74 and one or more partitions. The shell 74 has an inner surface 76 bounding the inner cavity 78 and an outer surface 72, which is the printing surface 30. A rotary union may be connected to the shaft to communicate with the inner cavity 78. Such a printing roller 16 may be rotated at a tangential velocity that is equal to or different from the machine direction velocity of the web 22, depending on the desired characteristics of the printed web. In other embodiments, in which the printing plate has a form other than that of a roller, such as that of a flat plate or a block, the printing plate may be moved in the machine direction at a velocity equal to or different from the machine direction velocity of the portion of the web 22 onto which the printing is being done. In some embodiments, the web 22 may be slowed or stopped while being impressed against the printing surface 30.

Figure 2:
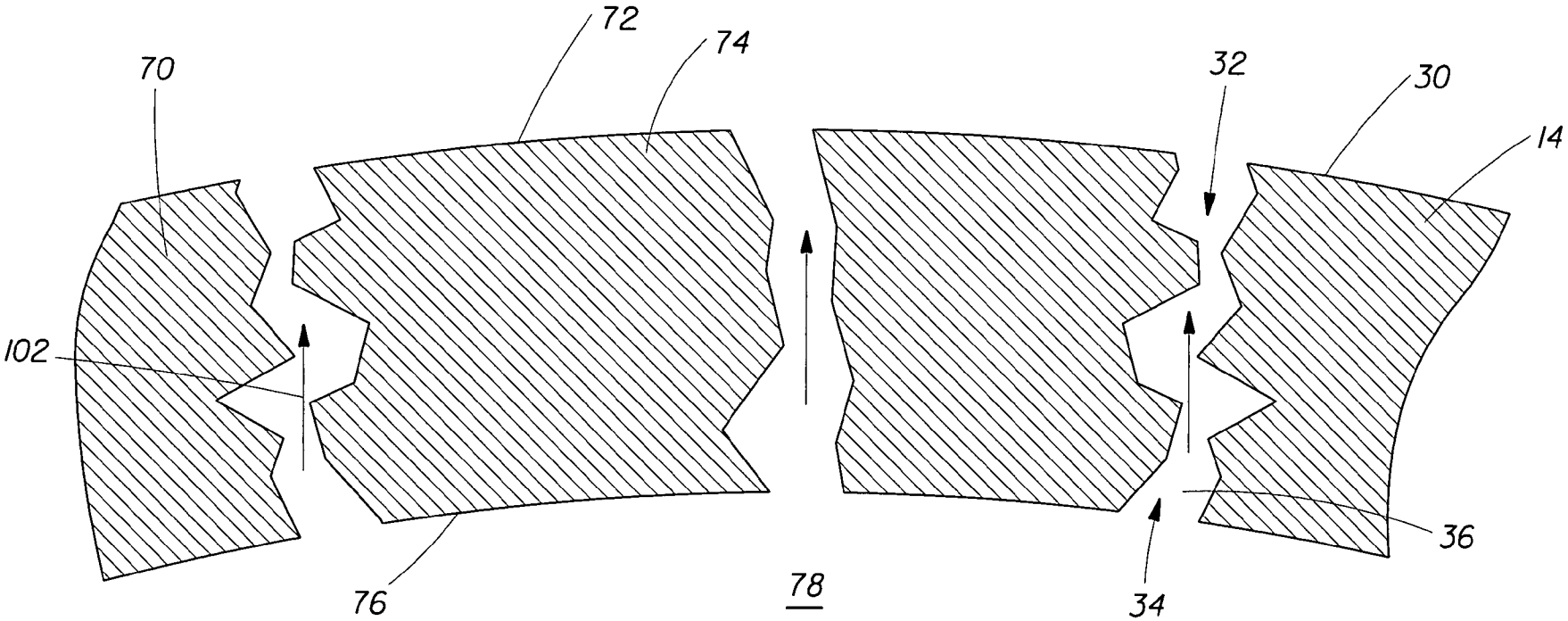
FIG. 2 shows a portion of the porous printing plate of the present invention.

The cylindrical shell 74 of the process roll 70 is porous, meaning that it has apertures in both the inner and printing surfaces and contains passages 36 communicating between the inner surface apertures 34 and the printing surface apertures 32, i.e., between the inner cavity 78 and the outer, printing surface 30, as shown in FIG. 2. The shell 74 may be made porous by various fabrication techniques. For example, the shell 74 may be machined to form passages 36, the shell 74 may be cast or molded with passages 36, or the shell 74 may be assembled as a composite of materials forming passages 36. Such fabrication techniques may include steps such as casting the shell 74 with removable materials present and then removing those materials to open the passages 36. In general, a material having interconnected void spaces forming passages 36 through its thickness may be used for the shell 74. It may be desirable to use a material that has substantially uniform porosity. Both the apertures and passages 36 have a size distribution, with the distribution of the sizes throughout the material being sufficiently random that the porosity and, therefore, the permeability, is essentially uniform over any selected cross section. A number of commercially available materials may be used for the porous shell 74, such as porous sintered powdered metals, e.g., porous sintered powdered stainless steel, porous resin-bound granular metal materials, apertured sheets, porous polymeric materials, metal or ceramic matrix composites, etc. An example is a cast material fabricated of aluminum granules bound with an epoxy resin.

Figure 3:
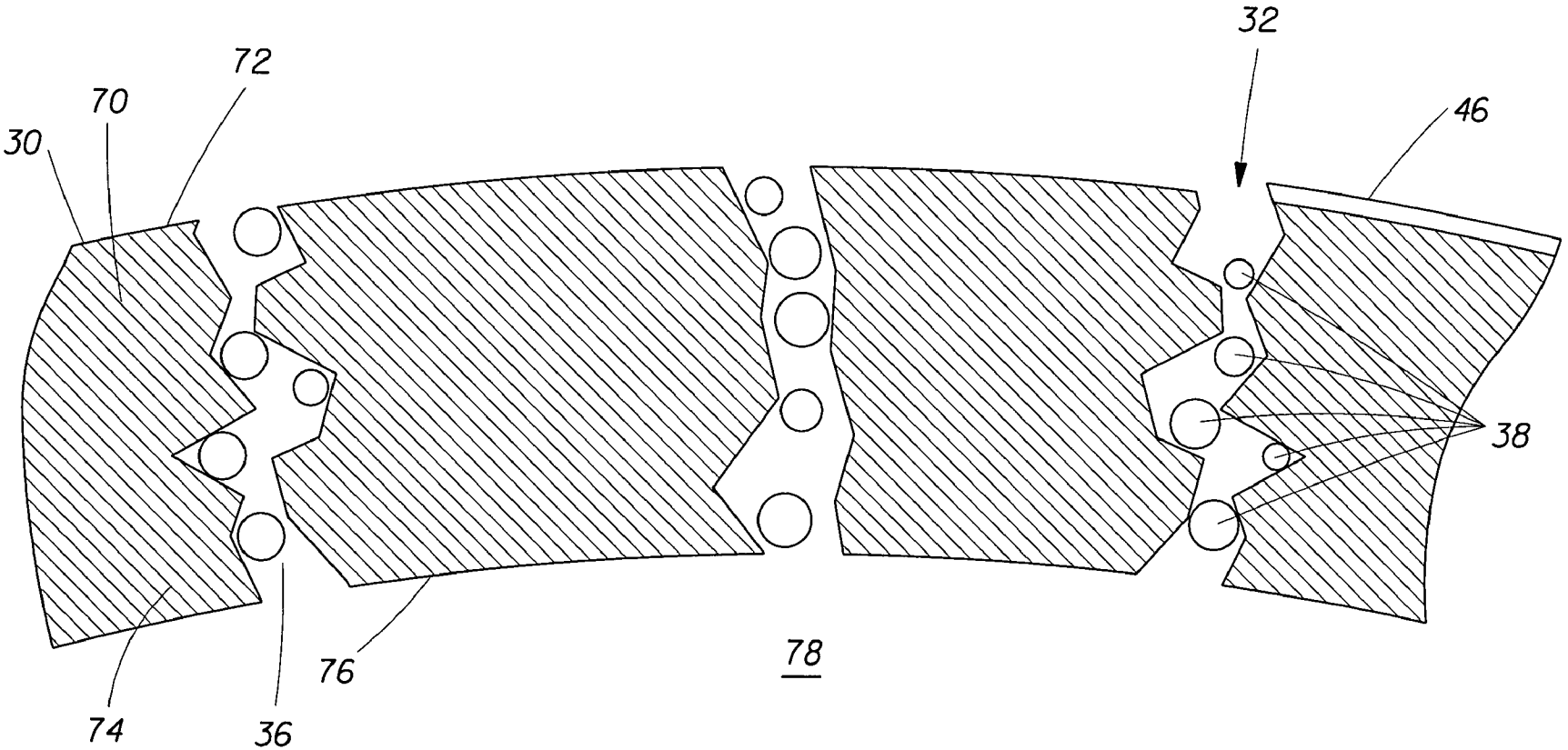
FIG. 3 shows a portion of the porous printing plate having particles lodged in the passages.

It may be necessary to reduce the porosity of such a commercially available material in order to render it usable in the process of the present invention. Such a reduction in porosity may be effected by the modification of the commercially available material by the impregnation or infiltration of particles 38 of another material, such as a ceramic material, into some or all of its passages 36, as shown in FIG. 3. The particles 38 that lodge in the passages 36 serve to restrict the flow of liquid through the affected passages 36. A material is selected that can withstand the expected temperature range and is inert in the presence of the fluid that will later flow through the porous material. The particles of this material are then forced into the apertures and passages of the porous material. For example, a porous material may have apertures and passages 36 whose effective open dimension ranges from 0.1 to 10 microns. Ceramic particles having a diameter of 0.01 to 5 microns can be forced by pressure to flow into the porous material. Some of the particles will become trapped within an aperture or passage 36, thereby reducing its open area and restricting the flow in that area. The amount of flow restriction that is achieved is a function of the quantity and sizes of particles 38 trapped in the porous material. This can be controlled through particle feed rate, particle size distribution, driving pressure, and infiltration time, until the desired permeability is achieved.

The printing surface 30 may have a durable release coating 46. A material providing a low surface energy effect in its solid or semi-solid form may be suitable for use as a release coating 46 on the printing surface 30. For example, a plasma coating, a coating containing a silicone compound, or a fluoropolymer coating may be applied to the printing surface 30 as a release coating 46. As mentioned above, the use of such a durable material may not be desirable in some embodiments. However, the use of such a durable release coating 46 in combination with the extrusion of a release agent or another first liquid may be particularly useful in some embodiments of the present invention. In some cases, the extruded liquid may, in effect, cushion or protect the durable release coating 46 and thereby extend its effective life. In some embodiments, portions of the printing surface 30 may be finished or polished to a high degree and thereby form a low energy surface without, or in addition to, a low surface energy coating. For example, a printing surface that is finished to a surface finish level of approximately Ra 315 microns may be suitable for use in a film printing process. As is known in the art, an Ra term expresses the arithmetical average surface deviation from a centerline through the relief in a surface.

A first liquid 100 and a second liquid 200 are supplied to the process by liquid delivery systems 100A, 200A. Each liquid delivery system preferably delivers its liquid at a determinate condition. For example, a liquid may be delivered at a determinate volumetric or mass feed rate, at a determinate pressure, at a determinate temperature, at a determinate state of another parameter, or at a combination of two or more of these conditions. Each liquid delivery system preferably includes a supply system, a liquid transport system, and a control system. In a system delivering a liquid at a determinate flow rate, for example, the control system preferably includes a measuring device, such as a flow sensor, a metering device, such as a positive displacement pump, and a feedback system to control the feed rate. Each liquid may be delivered continuously or intermittently. For example, in some embodiments, the interaction of the flow characteristics of the first liquid 100 with the structure of the passages 36 may be such that an intermittent, or pulsed, supply of the first liquid 100 yields the desired extrusion onto the printing surface 30. A continuous supply may be suitable for some embodiments, as well.

The first liquid 100 is delivered to the inner cavity 78 of the process roller 70 and from there is extruded through the passages 36 of the porous shell 74 and from the printing surface apertures 32 onto the outer surface 72. The direction of this flow through the passages 36 of the porous shell 74 is indicated by arrows 102 in FIGS. 1, 2, and 6 through 9. The first liquid 100 may comprise a single material or a mixture, a solution, or a suspension of suitable materials. For example, in some embodiments, the first liquid 100 may comprise a wetting agent, a lubricating agent, a release agent, a catalytic agent, an activating agent, or any other material suitable for the intended purpose. In embodiments in which a release agent is extruded as the first liquid 100, the release agent may contain any of various materials that may be suitable to prevent the adhesion of the second liquid 200 or of the sheet material 20 to the printing surface 30. In general, any liquid material that is compatible with the structural material of the printing apparatus 10 and with the second liquid 200 and the sheet material 20 may be used. In particular embodiments, a form of silicone, mineral oil, other oils, mixtures of fluoropolymers, water, and many other liquid materials providing a low surface energy effect on the printing surface 30 may be suitable for use as release agents. In an embodiment in which the process of the present invention is used to make a film for wrapping food or food containers, for example, the first liquid 100 may be a release agent containing a polysiloxane material, such as neat silicone.

Figure 4:
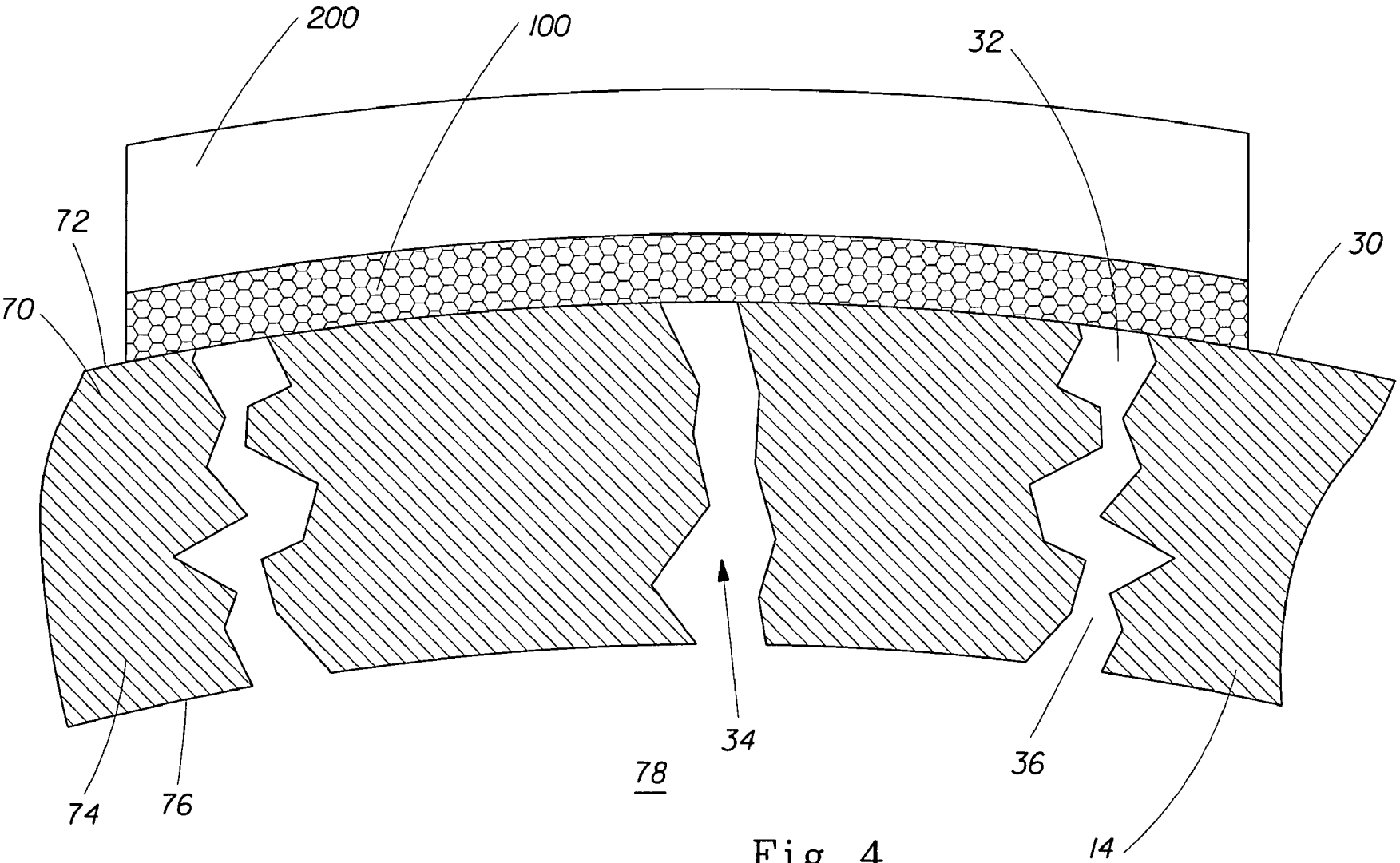
FIG. 4 shows a portion of the porous printing plate with layers of the first and second liquids on the printing surface.
Figure 9:
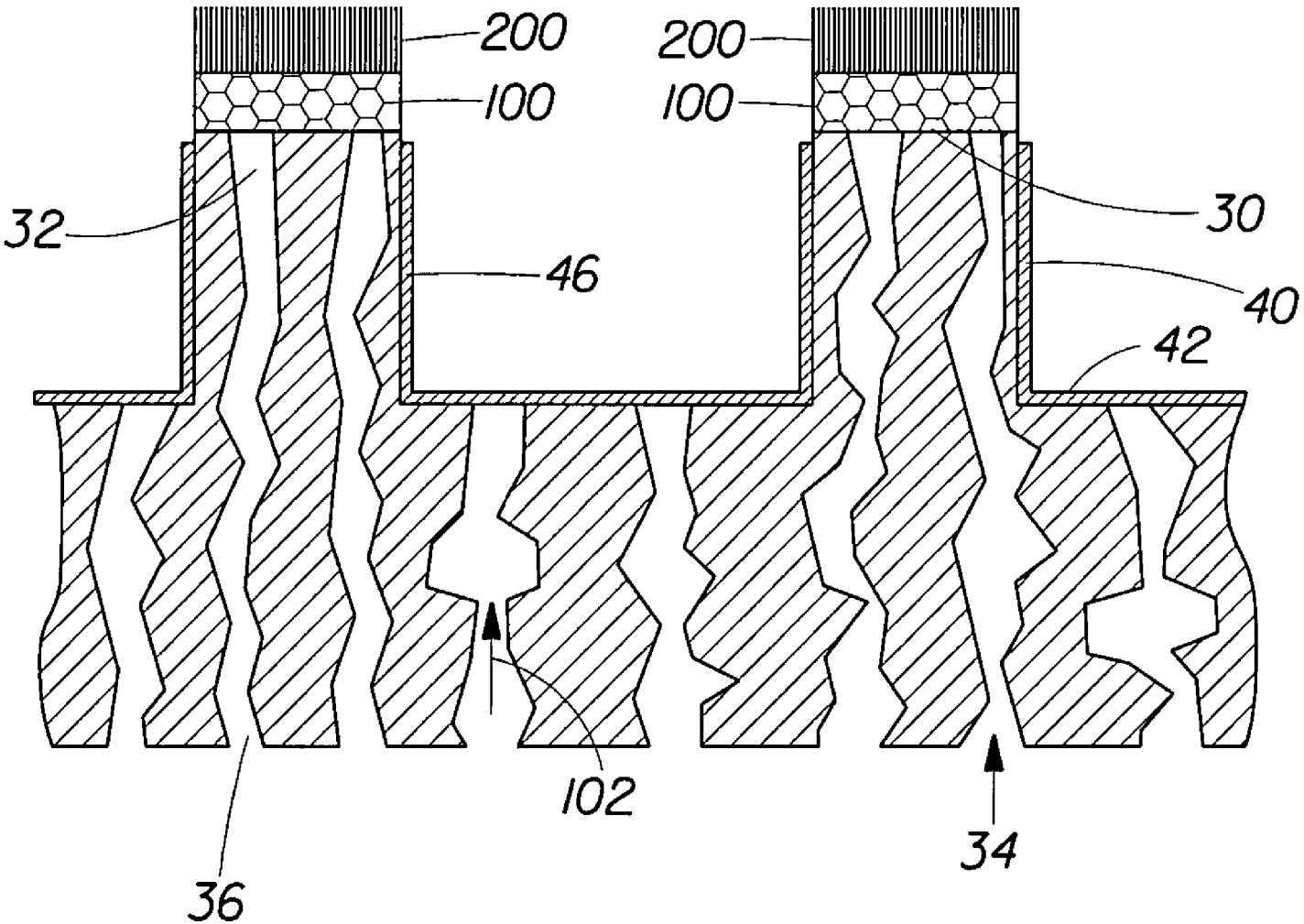
FIG. 9 shows a portion of the porous printing plate having raised and unraised areas and having closed apertures in the unraised areas, with layers of the first and second liquids on the printing surface.

The second liquid 200 is applied over and in contact with the first liquid 100 on the outer surface 72 of the process roller 70, as shown in FIGS. 1, 4, and 9. The second liquid 200 may be delivered to an applicator 18 having the form of a roller, a brush, an extruder, a sprayer, or any other form suitable for the application of the second liquid 200. The second liquid 200 may comprise a single material or a mixture, a solution, or a suspension of suitable materials. For example, in some embodiments, the second liquid 200 may comprise an ink, a dye, an adhesive, a catalytic agent, an activating agent, or any other material suitable for the intended purpose. In an embodiment in which the process of the present invention is used to make a film for wrapping food or food containers, for example, the second liquid 200 may be a pressure sensitive adhesive.

The sheet material 20 is contacted with the second liquid 200 on the outer surface 72 of the printing roller 16 to print the second liquid 200 onto the sheet material 20. The level of force or pressure that is required to print the second liquid 200 onto the sheet material 20 varies in relation to the particular liquids and sheet material 20 being processed. For example, to print a liquid having a relatively low viscosity onto a sheet material 20 having a relatively high absorbency may require relatively little pressure. On the other hand, to print a relatively highly viscous liquid onto a sheet material 20 having a relatively hard surface may require a relatively high level of pressure. In some embodiments for printing onto continuous webs, the maintenance of some acceptable level of web tension in the machine direction, combined with the routing of the web 22 so as to wrap the printing roller 16 over some relatively small arc, may suffice to generate the required level of pressure. Thus, in such an embodiment, the web tensioning system and the rollers or other components that route the web over an arc on the printing roller may serve as the impressing mechanism. A more complex impressing mechanism may be required in some embodiments, in order to generate the required pressure. For example, in the apparatus 10 of FIG. 1, such an impressing mechanism may have the form of a platen roller 12 serving to impress the sheet material 20 situated between it and a printing roller 16 against the printing surface 30. In another example, in an embodiment having a flat printing plate, a corresponding flat platen may serve to impress the sheet material 20 situated between it and the printing plate against the printing surface 30, or a traversing platen roller may be moved to progressively impress the sheet material 20 against the flat printing plate.

Some or all of the first liquid 100 may mix or react with the second liquid 200. Depending on the characteristics of the liquids, the mixing or reaction may commence as soon as the second liquid 200 is applied or later, such as when the pressure exerted by the sheet material 20 as it is impressed against the printing surface 30 causes the two liquids to mix. In embodiments in which the first and second liquids react, the reaction may be completed while the two liquids are on the printing surface 30 or after the printing onto the sheet material 20. As an example of such an embodiment, the present invention may be used to mix and activate a two part adhesive at the point of its application to a sheet material 20. The partial mixing of a two part adhesive, such as an epoxy resin and a hardener, may occur on the printing surface 30, so long as the adhesion of the mixed adhesive to the printing surface 30 is avoided. In some cases, it may be possible to mix the two parts when the sheet material 20 is impressed, in such a way that the fluid extruded through the printing surface 30 acts as a release agent to prevent the adhesion of the second fluid or of the mixed adhesive to the printing surface 30. Similarly, a liquid containing a volatile material may be combined with another liquid and printed onto a sheet material 20 through the use of the present invention.

An apparatus 10 of the present invention may be self-cleaning to some extent, since the first liquid 100 is supplied under pressure from beneath the surface on which an accumulation of the second liquid 200 might occur and therefore from beneath such accumulation. The processing of an otherwise unsuitable liquid or sheet material 20 may be made practical by this self-cleaning aspect of the present invention, especially, for example, in an embodiment as described above in which a two part adhesive is mixed, or in another embodiment in which the nature of a material or of an intended product precludes the use of a release agent as the first liquid 100.

After the second liquid 200 is printed onto the sheet material 20, the sheet material 20 is separated from the printing surface 30. In a web embodiment, the machine direction tension present in the web 22 may be sufficient to pull the web 22 away from the printing surface 30. As noted above, in an embodiment in which a relatively aggressive adhesive is printed onto a relatively thin and conformable film, such as in the manufacture of a film for wrapping food or food containers, the avoidance of ruptures or distortion is especially important. Therefore, in such an embodiment, the present invention may provide an important benefit by reliably preventing the adhesion of the adhesive and the film to the printing surface 30 and thereby making it practical to separate the printed film from the printing surface 30 with an acceptably low level of machine direction tension. As shown in FIG. 1, some or all of the first liquid 100 may be removed from the printing surface 30 and travel with the sheet material 20 when the sheet material 20 is separated from the printing surface 30.

The amount of each of the first and second liquids delivered to the process may be controlled in various ways and with respect to various other factors. In some embodiments, because the second liquid 200 is the printing agent, the amount of the second liquid 200 may be controlled in proportion to the area of the sheet material 20 being processed. In an embodiment in which a film for wrapping food or food containers is printed with an adhesive, for example, the second liquid 200, which is the adhesive, may be applied at a rate as low as 0.5 gram per square meter of the film. For some film wrap products, the rate of application of the adhesive may be as high as 5 grams per square meter of the film. A typical rate of application of the adhesive may be about 2 grams per square meter of the film for such an embodiment.

The amount of the first liquid 100 may also be controlled in proportion to the area of the sheet material 20 being processed. In the film wrap embodiments described above, the first liquid 100, which is a release agent, may be extruded at a rate as low as 0.0001 gram per square meter of the film through the use of the present invention. Under some conditions, such as at a relatively higher rate of application of the adhesive, the release agent may be extruded at a rate as high as 0.1 gram per square meter of the film. In particular embodiments, a typical rate of extrusion of the release agent may be about 0.003 gram per square meter of the film.

Alternatively, the amount of the first liquid 100 may be controlled in proportion to the amount of the second liquid 200 being applied. For example, any proportional relationship of the application and extrusion rates and ranges already mentioned may be suitable for a particular embodiment in which a film wrap is processed. As a specific example, in an embodiment in which the adhesive is applied at a rate of 2 grams per square meter and the release agent is extruded at a rate of 0.003 gram per square meter, both areas being those of the film being processed, the amount of the release agent is 0.15 percent of the amount of the adhesive. For a particular adhesive and a particular release agent, this ratio may be suitable over a wide range of adhesive application rates, and the amount of the release agent may, therefore, be controlled in proportion to the amount of the adhesive, rather than being independently adjusted or controlled in proportion to the film area. Similarly, in other embodiments, the proportion of the first liquid 100 to the second liquid 200 may be a parameter of interest, for example, in the mixing of a two part adhesive or in the mixing of a first liquid 100 containing a volatile material with a particular second liquid 200.

The extruded amount of the first liquid 100 may be controlled in a variety of ways. For example, the extruded amount may be controlled by controlling the delivery pressure of the first liquid 100, since the flow rate and the pressure reduction during extrusion are typically related in a predictable manner. Also, the extruded amount may be controlled directly by delivering the first liquid 100 under volumetric control, such as by means of a positive displacement pump. Alternatively, the viscosity of the first liquid 100 may be controlled in order to control the extruded amount. In an embodiment in which a silicone release agent is extruded, for example, the viscosity, and thereby the extruded amount, can be controlled by controlling the temperature of the release agent. The temperature of the first liquid 100 may be controlled by any suitable means, such as through the exchange of heat energy between the first liquid 100 and a liquid heat exchange medium.

In embodiments in which a process roll 70 is rotated, the centrifugal force generated by the rotation may be used to control the extruded amount of the first liquid 100. For example, the radially outward direction of the centrifugal force may align with the general direction of the flow of the first liquid 100 toward the printing surface 30 and may, therefore, act as a driving force for the flow. Also, in a more complex embodiment, the centrifugal force may serve to actuate a mechanism providing a differential pressure to drive the flow toward the printing surface 30. The centrifugal force is proportional to the rotational velocity and the tangential velocity of the process roll 70. Thus, in embodiments in which the process roll 70 is rotated at a tangential velocity that is proportional to the machine direction velocity of the sheet material 20, the centrifugal force is also proportional to the rate at which the sheet material 20, in terms of area, is being processed. In such an embodiment, the proportional centrifugal force may be used in a substantially automatic system for the control of the extruded amount of the first liquid 100.

The temperature of the printing plate may also be controlled in order to achieve certain desired effects, such as the control of the temperature of the first liquid 100 or the prevention of the adhesion of a second liquid 200 to the printing surface 30. In such an embodiment, the temperature of the printing plate may be controlled by exchanging heat energy between the printing plate and a circulating liquid heat exchange medium in an internal heat exchanger, for example. In an embodiment in which the printing plate 14 has the form of a printing roller 16, this internal heat exchanger may have the form of a second inner cavity 80 inside the process roll 70. Other methods known in the art, such as radiant heating of the printing plate or heating of the printing plate by means of an internal electric resistance heating element, may also be used.

Figure 5:
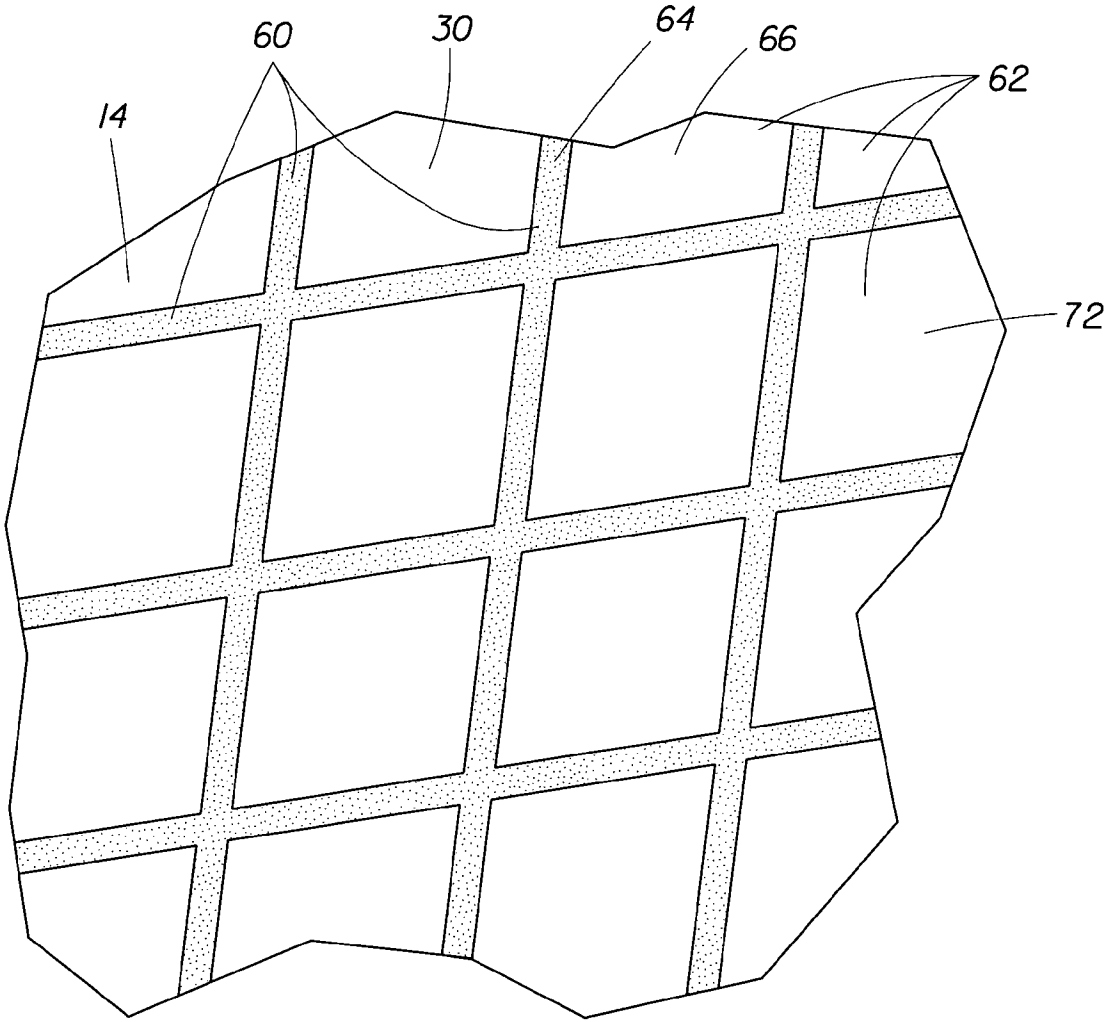
FIG. 5 shows a portion of the printing surface having pattern and non-pattern zones.
Figure 6:
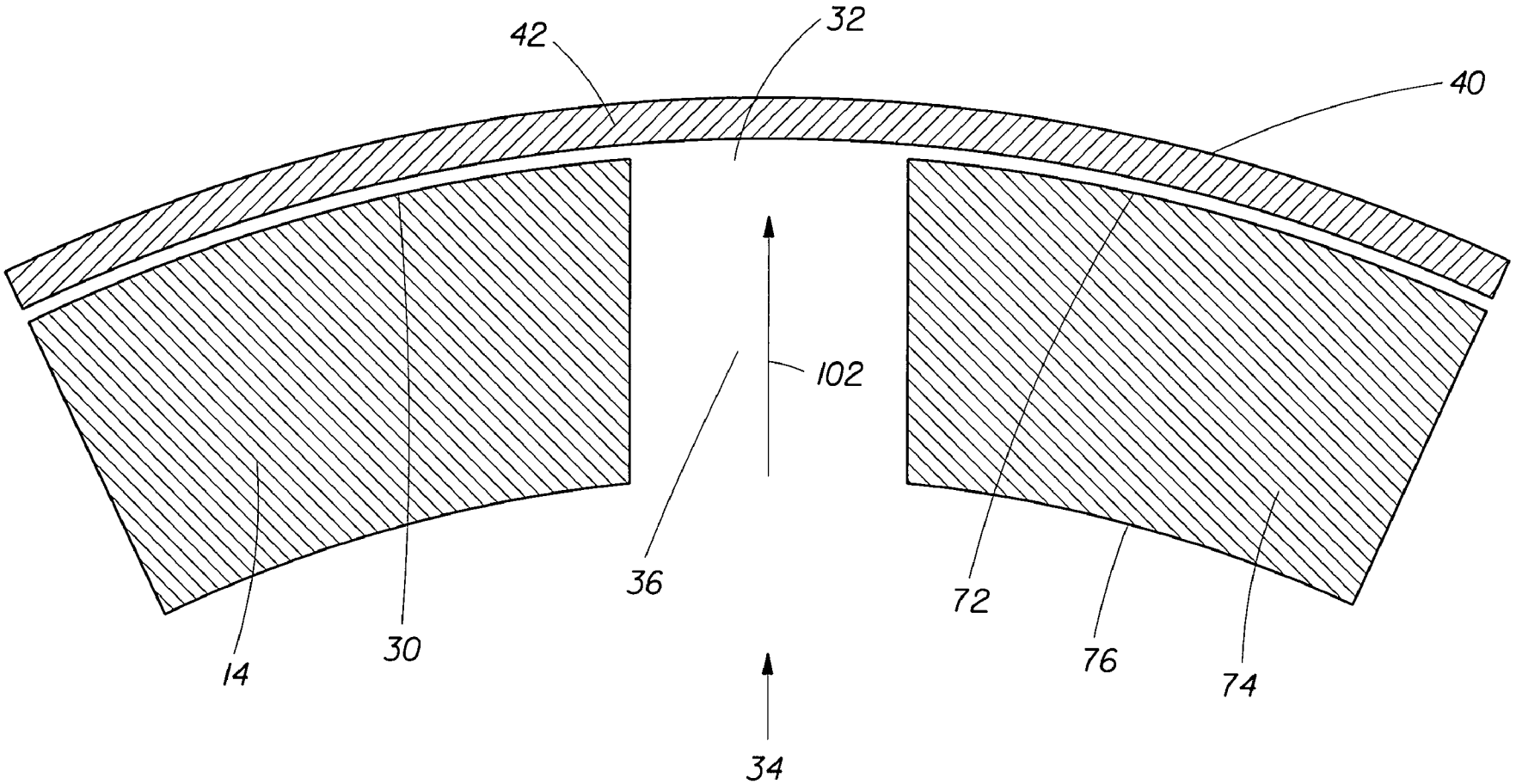
FIG. 6 shows a portion of the porous printing plate having a closed printing surface aperture.
Figure 8:
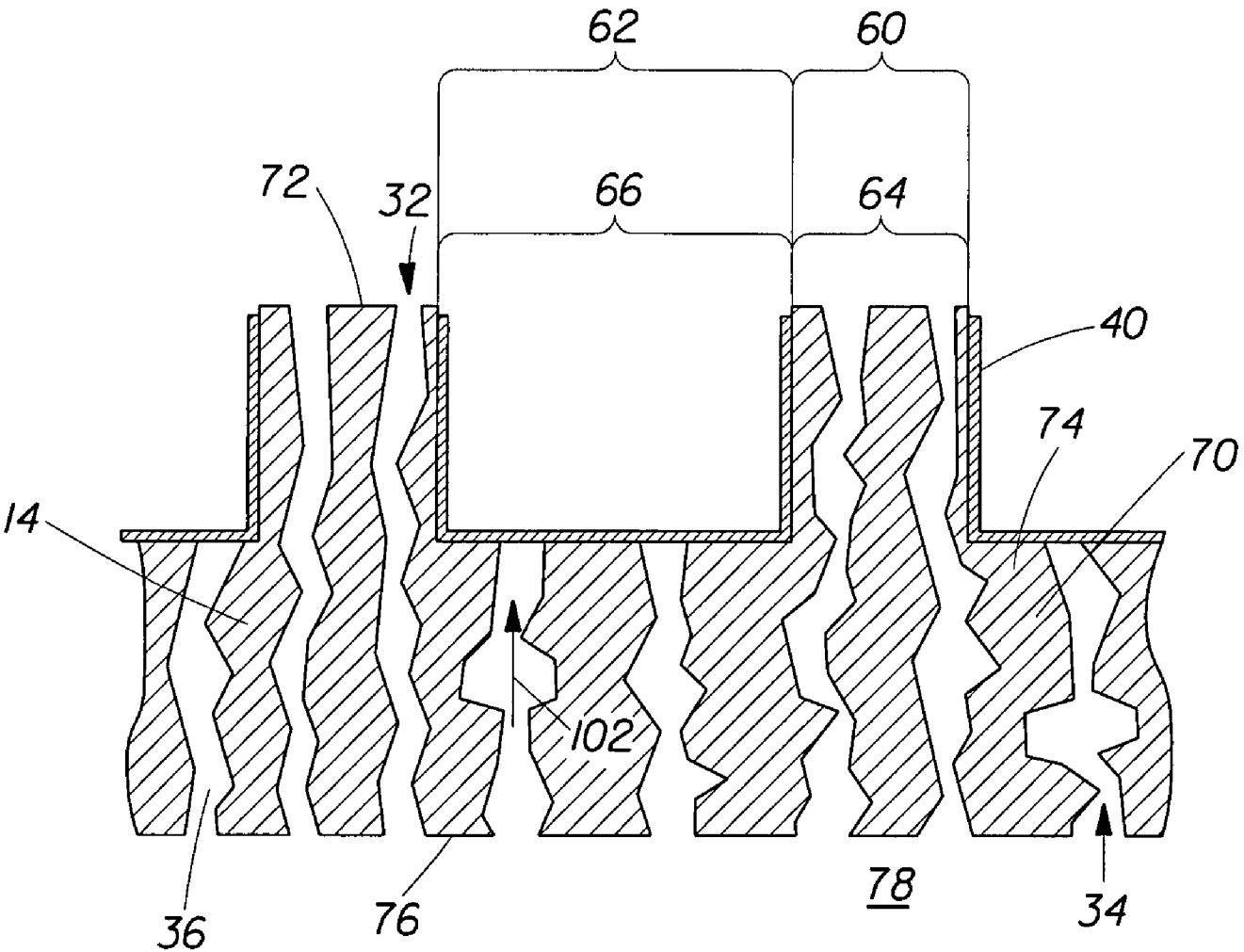
FIG. 8 shows a portion of the porous printing plate having raised and unraised areas and having closed apertures in the unraised areas.

The printing surface 30 may have a pattern zone 60 and a non-pattern zone 62, as shown in FIG. 5. In such an embodiment, the first liquid 100 may be extruded from the printing surface 30 apertures in the pattern zone 60 and substantially not extruded from the printing surface apertures 32 in the non-pattern zone 62. The apertures in the non-pattern zone 62 may be substantially closed and thereby restrict or block the flow of the first liquid 100 onto the printing surface 30. For example, the apertures in the non-pattern zone 62 may be closed by the application of a coating 40 or other material onto the printing surface 30, as shown in FIGS. 6, 8, and 9. As another example, the apertures in the non-pattern zone 62 may be closed by molten material 42 formed during a treatment of the printing surface 30 with heat. In some embodiments, some or all of the printing surface apertures 32 may first be closed, such as by the application of a coating 40 or by molten material 42, and then selected areas of the printing surface 30 may be treated or machined to remove the material blocking the printing surface apertures 32, so as to reopen the printing surface apertures 32 in those areas.

Figure 7:
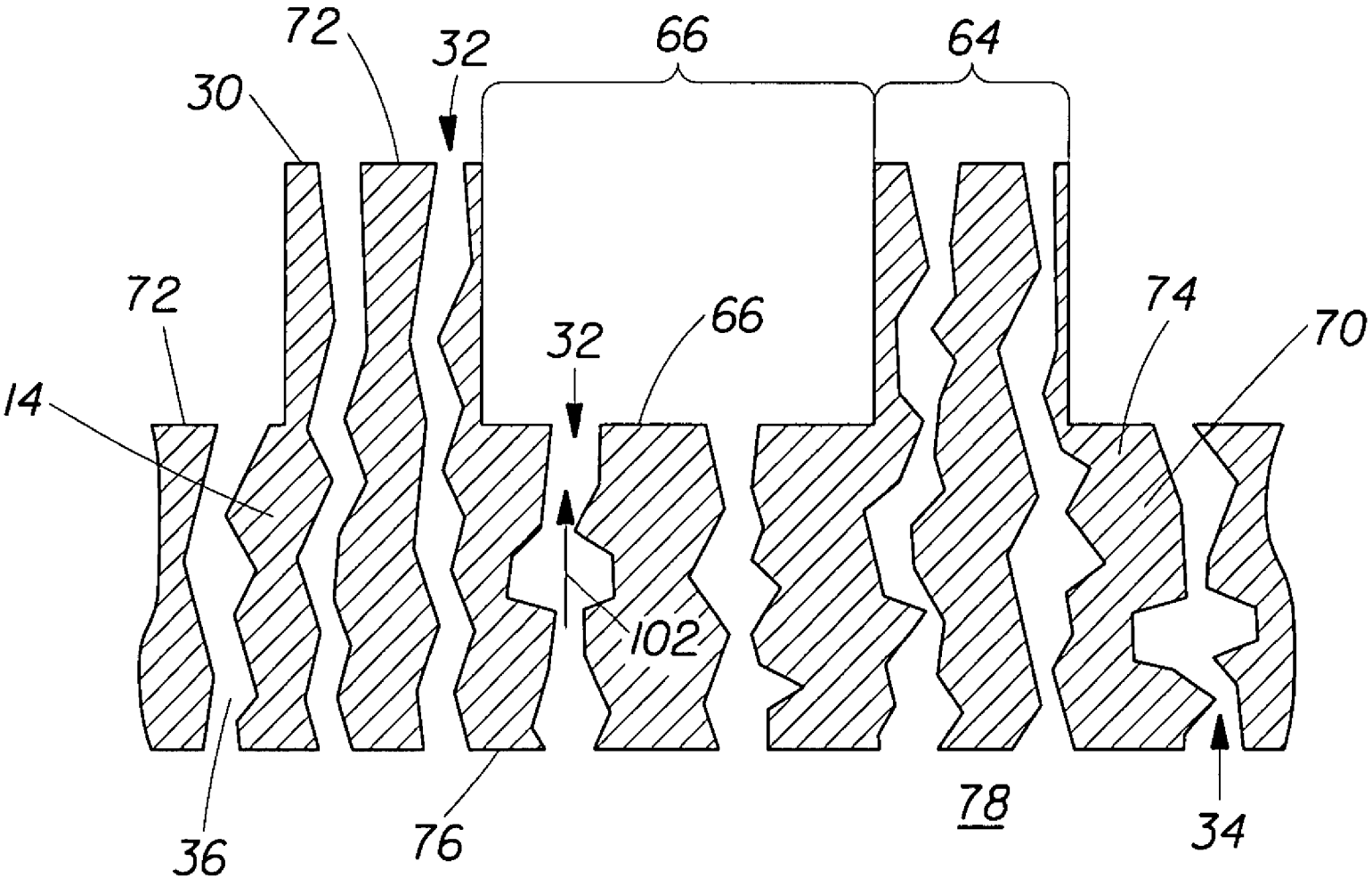
FIG. 7 shows a portion of the porous printing plate having raised and unraised areas.

A portion of the printing surface 30 may be raised in relief, as shown in FIGS. 7, 8, and 9. For example, the pattern zone 60 in an embodiment having pattern and non-pattern zones may be raised in relief, relative to the non-pattern zone 62. In some embodiments, the raised pattern zone 60 may form a continuous network of interconnected raised areas 64 surrounding unraised areas 66. Thus, in such an embodiment in which the apertures in the non-pattern zone 62 are closed, the first liquid 100 may be extruded onto only the raised portions of the printing surface 30. For example, in an embodiment in which the process of the present invention is used to make a film for wrapping food or food containers, and in which the first liquid 100 is a release agent and the second liquid 200 is an adhesive, the release agent may be extruded onto the printing surface 30 of a process roll 70 only on a raised pattern zone 60, the adhesive may be applied over the release agent on the raised pattern zone 60, and the adhesive may then be printed onto the film in a pattern matching the raised pattern of the printing surface 30 of the process roll 70.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention.

What is claimed is:

1. A method for cleaning a process surface, the method comprising steps of:

a) providing a porous process surface comprising a first surface, a second surface, and apertures extending from the first surface to the second surface; the process surface having an accumulation of a second liquid on the first surface, b) extruding a first liquid from the second surface through the apertures onto the first surface beneath the accumulation of the second liquid;

c) removing the accumulated second liquid from the first surface.

2. The method of claim 1 further comprising the step of controlling an extruded amount of the first liquid in proportion to an amount of the accumulated second fluid.

3. The method according to claim 1 further comprising the step of controlling the temperature of the process surface.

4. The method according to claim 1 further comprising the step of controlling the temperature of the first liquid.

* * * * *